US007500577B2

(12) United States Patent
Wichelhaus

(10) Patent No.: US 7,500,577 B2
(45) Date of Patent: Mar. 10, 2009

(54) RE-CLOSABLE LID, IN PARTICULAR OF A BEVERAGE CAN, HAVING ROTATABLE OPENER TAB WITH A CLOSURE ATTACHMENT

(75) Inventor: André Wichelhaus, Weinstadt (DE)

(73) Assignee: IMV Innovation Marketing und Vertriebs GmbH, Stuttgart (DE)

( * ) Notice: Subject to any disclaimer, the term of this patent is extended or adjusted under 35 U.S.C. 154(b) by 374 days.

(21) Appl. No.: 10/540,285

(22) PCT Filed: Dec. 19, 2003

(86) PCT No.: PCT/EP03/14675

§ 371 (c)(1),
(2), (4) Date: Feb. 6, 2006

(87) PCT Pub. No.: WO2004/056667

PCT Pub. Date: Jul. 8, 2004

(65) Prior Publication Data

US 2006/0163254 A1 Jul. 27, 2006

(30) Foreign Application Priority Data

Dec. 20, 2002 (DE) ..... 102 61 232

(51) Int. Cl.

| | |
|---|---|
| ***B65D 17/34*** | (2006.01) |
| ***B65D 17/32*** | (2006.01) |
| ***B65D 51/18*** | (2006.01) |
| ***B65D 51/20*** | (2006.01) |
| *B65D 41/32* | (2006.01) |

(52) U.S. Cl. ..... 220/254.4; 220/269; 220/906

(58) Field of Classification Search ..... 220/254.2, 220/254.4, 258.2–258.5, 269, 270, 272, 273, 220/619, 821, 906

See application file for complete search history.

(56) References Cited

U.S. PATENT DOCUMENTS 3,259,265 A * 7/1966 Stuart ..... 220/269

(Continued)

FOREIGN PATENT DOCUMENTS

DE 39 31 573 C2 9/1989

(Continued)

OTHER PUBLICATIONS

Office Action in JP Patent Application No. P2004-561402, Date of Mailing Jan. 8, 2008, under Art. 29(2).

*Primary Examiner*—Anthony D Stashick
*Assistant Examiner*—Ned A Walker
(74) *Attorney, Agent, or Firm*—Schlee IP International, P.C.; Alexander R. Schlee

(57) ABSTRACT

Re-closable lid, in particular for a drinks can, with a cutout portion (13*a*), which is provided in the lid plate (11) and is bounded by a predetermined breaking line (12), and also an opener tab (14), which is pivoted mounted on the lid plate (11) for breaking open the predetermined breaking line. The fastening tongue (16) of the opener tab (14) has a freely twistable portion (16*a*) and, on the underside of the gripping portion (18) of the opener tab (14), there is formed a flat closure attachment (31), which fits into the opening (13*b*) produced by breaking open the predetermined breaking line (12) and is formed for re-closing the opening (13*b*).

20 Claims, 6 Drawing Sheets

U.S. PATENT DOCUMENTS

| | | | | | |
|---|---|---|---|---|---|
| 3,967,752 | A | | 7/1976 | Cudzik | |
| 4,024,981 | A | * | 5/1977 | Brown | 220/269 |
| 4,442,950 | A | | 4/1984 | Wilson | |
| 4,463,866 | A | | 8/1984 | Mandel | |
| 4,524,879 | A | * | 6/1985 | Fundom et al. | 220/273 |
| 4,605,141 | A | | 8/1986 | Won | |
| 4,681,238 | A | * | 7/1987 | Sanchez | 220/260 |
| 4,717,039 | A | | 1/1988 | Ayyoubi | |
| 4,720,022 | A | | 1/1988 | Gomes | |
| 4,815,626 | A | * | 3/1989 | Yamanashi | 220/273 |
| 4,821,912 | A | * | 4/1989 | Wells | 220/231 |
| 4,951,835 | A | * | 8/1990 | DeMars et al. | 220/269 |
| 4,979,635 | A | * | 12/1990 | Levine | 220/269 |
| 5,080,249 | A | * | 1/1992 | Shock | 220/269 |
| 5,219,257 | A | * | 6/1993 | Koch | 413/67 |
| 5,779,087 | A | * | 7/1998 | Sharpe et al. | 220/269 |
| 5,813,559 | A | | 9/1998 | Cho | |
| 5,975,327 | A | * | 11/1999 | Funk | 220/269 |
| 6,059,137 | A | * | 5/2000 | Westwood et al. | 220/258.2 |
| 6,138,856 | A | * | 10/2000 | Ghim et al. | 220/269 |
| 6,158,608 | A | * | 12/2000 | Schlattl | 220/253 |
| 6,286,703 | B1 | * | 9/2001 | Munro | 220/269 |
| 6,347,720 | B1 | * | 2/2002 | Schley | 220/258.4 |
| 6,427,861 | B1 | * | 8/2002 | Cho | 220/269 |
| 6,460,719 | B1 | * | 10/2002 | Finmark | 220/258.5 |
| 6,722,518 | B1 | * | 4/2004 | Bartz | 220/254.4 |
| 6,763,963 | B1 | * | 7/2004 | Martin | 220/254.2 |
| 6,793,087 | B2 | * | 9/2004 | Dyren | 220/254.4 |
| 2003/0102313 | A1 | * | 6/2003 | Weber | 220/254.4 |

FOREIGN PATENT DOCUMENTS

| | | | |
|---|---|---|---|
| DE | G 89 11 286.5 | | 9/1989 |
| DE | 41 03 746 | A1 | 2/1991 |
| DE | 41 11 364 | A1 | 4/1991 |
| DE | 91 02 413.7 | | 5/1991 |
| DE | G 91 09 081.4 | | 7/1991 |
| DE | 43 35 709 | A1 | 10/1993 |
| DE | 94 03 674.8 | | 5/1994 |
| DE | G 94 09 042.4 | | 6/1994 |
| DE | 44 43 579 | A1 | 12/1994 |
| DE | 295 13 370 | U1 | 8/1995 |
| DE | 296 15 277 | U1 | 9/1996 |
| DE | 197 50 783 | A1 | 11/1997 |
| DE | 298 03 271 | U1 | 2/1998 |
| DE | PCT/DE1997/002062 | | 3/1998 |
| DE | 298 15 369 | U1 | 8/1998 |
| DE | 298 16 084 | U1 | 9/1998 |
| DE | 299 00 136 | U1 | 1/1999 |
| EP | 0 558 442 | A1 | 9/1993 |
| FR | PCT/FR1998/001271 | | 12/1999 |
| GB | 1 540 229 | | 2/1979 |
| JP | 51-082188 | | 7/1976 |
| JP | 2000-264355 | | 9/2000 |
| JP | 2002-512927 | | 5/2002 |

* cited by examiner

RE-CLOSABLE LID, IN PARTICULAR OF A BEVERAGE CAN, HAVING ROTATABLE OPENER TAB WITH A CLOSURE ATTACHMENT

CROSS-REFERENCE TO RELATED APPLICATIONS

This application is based on International patent application PCT/EP2003/014675 having a filing date of Dec. 19, 2003 that claims priority from German Patent Application DE 102 61 232.3 having a filing date of Dec. 20, 2002, the entire content of which is herewith incorporated by reference.

BACKGROUND OF THE INVENTION

1. Field of the Invention

The invention relates to a lid of a container, in particular a beverage can, with a breakout portion, which is formed in the lid plate and can be broken out by means of an opener tab, so that an access opening to the contents of the container is produced, and with a closure attachment on the opener tab, with which the access opening can optionally be re-closed.

The lid plate and the opener tab are respectively produced in a shaping manner from a thin, profiled plate material by a primary forming technique, or in particular by a re-forming technique, by punching and/or deep-drawing. The opener tab and/or the lid plate is produced from a plastics material, which is possibly fiber-reinforced, or—preferably—from a metal sheet material, in particular from an aluminum alloy or iron alloy.

A lid according to the invention can be provided on containers for receiving a flowable substance, such as a powdered or granular substance, for example coffee powder or cocoa powder, powdered soup or other prepared powder or granules for domestic use, or in particular a liquid, which may also contain solids, for example a liquid for drinking, a liquid broth or soup, an oil and the like. A lid according to the invention may also be intended for other liquid or powder containers, which contain for example a liquid, powdered or granular cleaning agent or treating agent or the like.

Such lids of a beverage can or a powder container with a breakout portion in the lid plate, which is at least partly bounded by a predetermined breaking line, and an opener tab, which is pivotably fastened, by means of a fastening tongue that can be bent about its foot, next to the breakout portion on the lid plate at a fastening stud, in particular in the form of a hollow rivet or solid rivet, are widely known. The fastening tongue is arranged in a cutout of the opener tab between a gripping portion and a pressing portion of the opener tab and, in the same way as the rim portion of the breakout portion alongside the fastening stud and therefore the opening produced by breaking it out, ends with its foot directly at the head of the fastening stud. By lifting the gripping portion in the opener pivoted position of the opener tab, its pressing portion protruding over the breakout portion is swung downward about the foot of the fastening tongue, so that the breakout portion is pressed down and, as a result, is broken out along the predetermined breaking line. Usually, the broken-out portion, which remains hanging from the rim of the opening produced at a point of interruption of the predetermined breaking line, is then swung further under the lid plate by further swinging up of the opener tab, by the pressing portion of the latter.

2. Description of Related Art

Various devices to make it possible for the broken-out opening in the lid of a beverage can to be re-closed after opening are known, for example from WO 98/12118 A2. In the cited known beverage can, between the opener gripping tab and the lid plate fixed to the beverage can there is provided an additional closure plate, which is pivotably fastened with the aid of a peripheral bulge in a peripheral groove formed in the lid plate and has an opening which corresponds to the opening broken out from the lid plate. By pivoting of the closure plate, possibly together with the opener tab, the closure plate opening can be pivoted away from the opening in the lid plate and, as a result, the latter can be re-closed.

According to WO 99/65780 A1, provided as a replacement for the customary opener tab is a specially designed plastics body, which serves for opening a drinking opening by breaking out a breakout portion of the lid plate and at the same time for renewed closing of this drinking opening. The plastics body is fastened to the lid plate in such a way that it can be swung and pivoted and elastically deflected with the aid of a flexibly deformable stud, which is riveted onto the lid plate and has, as a head, an axial web that extends transversely and protrudes on both sides, in order that the plastics body can be moved over the breakout portion and swung about the axial web for breaking out the breakout portion, and the opening produced as a result can be re-closed with the aid of a closure attachment after pivoting of the plastics body by 180°. A sliding groove for the axial web may be provided in the plastics body, in order that, for its swinging movement, the plastics body can be additionally displaced into a position suitable for the breaking out of the breakout portion.

According to DE 89 11 286 U1, on the other hand, the opener tab pivotably fastened at a rivet has a depression on its gripping portion, so that on the underside of the gripping portion facing the lid plate there is formed a closure attachment which protrudes at an angle from a wide covering collar of the gripping portion. The opener tab consists of spring plate and the closure attachment is curved in an arcuately convex manner and is larger at the covering collar than the broken-out opening, so that, in an opener pivoted position, the closure attachment is resiliently pressed with its convexity into a receiving hollow in the lid plate and, after the pivoting of the opener tab about the fastening stud into a closure pivoted position, is resiliently pressed with its convexity onto the bounding edge of the opening, in order to re-close the opening. In the opener pivoted position and in the closure pivoted position, the covering collar protrudes obliquely upward above the lid plate at a distance above the axially protruding rim of the lid. The opener tab has a semicircular wide fastening tongue, which as a result is intended to be resiliently deflectable about a bending line perpendicularly crossing the rivet axis. The opener tab must be prestressed relatively strongly, in order that, with the only slight deflection of the opener tab about the bending line, a sufficiently large spring force is present at the foot of the fastening tongue to press the convexly curved closure attachment against the bounding edge of the opening. The strong prestressing of the opener tab has the effect on the other hand that the fastening stud of the opener tab is subjected to very strong loading, which can cause the fastening stud to be broken out from the thin lid plate if, when opening the lid, the breakout portion is to be pressed down with great force until breaking out from the lid plate occurs.

In the case of other known constructions (for example EP 0 558 442 A1), therefore, a separate closure shoe is pushed onto the gripping portion of the opener tab, which shoe is pivotably guided on the rim of the can and pivoted over the opening by pivoting the opener tab about the fastening stud, so that the closure shoe rests on the bounding rim of the opening in a sealing manner.

BRIEF SUMMARY OF THE INVENTION

The invention provides a lid of a container, in particular a beverage can, in which the opening which is produced by breaking out the breakout portion of the lid plate can be effectively re-closed by simple means with the aid of the opener tab. The lid according to the invention is suitable for mass production accompanied by simple handling and great ease of use of the lid closure.

As explained in more detail in connection with the description of the exemplary embodiments, the lid according to the invention of a container, in particular a beverage can, is provided with a lid plate, in which a breakout portion is formed, and with an opener tab, which is pivotably fastened with a fastening tongue at a fastening stud of the lid plate next to the breakout portion, so that the breakout portion can be pressed down and thereby broken out in an opener pivoted position of the opener tab by a pressing portion of the opener tab by means of lifting its gripping portion, and in the lid plate there is produced an opening which is bounded by a bounding rim.

According to the invention, the gripping portion of the opener tab has a closed depression formed into its upper side at a distance on all sides from its outline, so that from the underside there protrudes a flat closure attachment, which in side view is substantially rectangular overall, or virtually rectangular, and the base of which is surrounded by a covering collar on the underside of the gripping portion. The closure attachment fits with its peripheral surrounding surface instead of the breakout portion in the bounding rim of the opening broken out from the lid plate substantially until the covering collar rests on the bounding rim.

Moreover, according to the invention, the fastening tongue is formed such that it is longer than those of the customary opener tabs, so that the opener tab can be relatively rigid for vigorous breaking out of the breakout portion and, nevertheless, a certain mobility is allowed for the positionally correct pressing down of the closure attachment into the opening, in order to allow a certain degree of compensation for deviations from the desired position of the opener tab in relation to the opening and dimensional changes caused by distortions and flexural deformations of the lid plate, which may occur during production and in particular during the breaking out of the breakout portion.

In further refinements of the invention it is envisaged to make the opener tab as flexurally rigid as possible, with the exception of the fastening tongue, with the aid of formed-in reinforcing beads and/or formed-out reinforcing bulges, and also to reinforce those regions of the lid plate on which deforming forces act, in particular during the pressing down and breaking out of the breakout portion, with the aid of formed-in reinforcing beads or other formed-out reinforcements. Reinforcements of the pressing portion are preferably formed with the aid of bulges protruding toward the upper side, whereas reinforcements of the lid plate are preferably formed as beads formed into its upper side, in order that there are least possible hindrances for the pivotability of the opener tab with as flat a design as possible.

Such reinforcements of the opener tab and/or lid plate achieve the effect that, in spite of the bendability of the fastening tongue, as far as possible no deviations or only minor deviations occur in the dimensions and the position in particular of the closure attachment in relation to the broken-out opening in symmetry with the fixed-in-place fastening stud.

BRIEF DESCRIPTION OF THE DRAWINGS

The invention and its further preferred refinements are explained below on the basis of exemplary embodiments, the features of which can be seen from the drawing, in which:

FIGS. 4 to 8 show a currently preferred exemplary embodiment of a lid according to the invention of a beverage can, in each case in an enlarged representation, but not always to scale, with;

Figure 9:
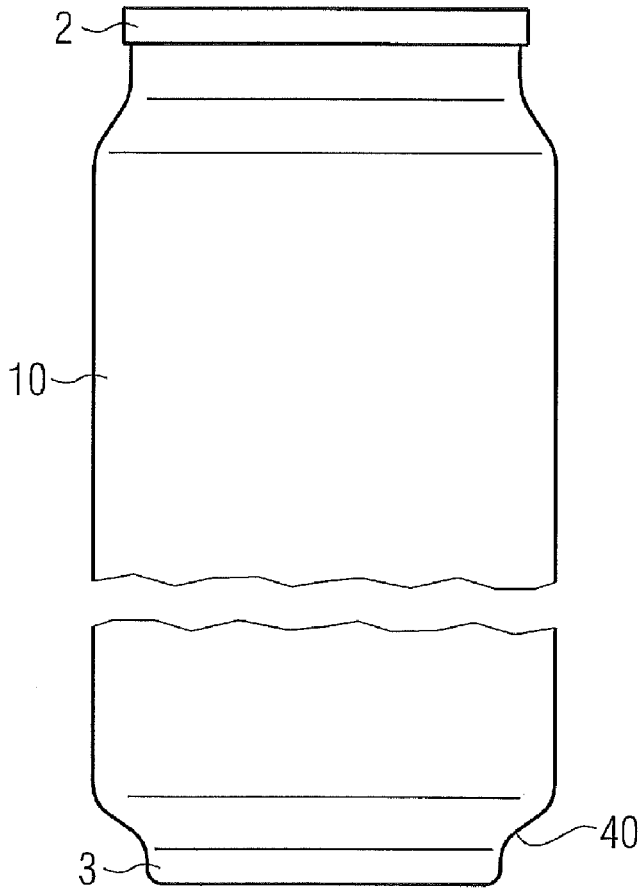

- a plan view of the lid with the opener tab in the opener pivoted position in FIG. 4,
- a plan view of the lid with the opener tab in the closure pivoted position in FIG. 5,
- a view of the lid plate from below FIG. 6,
- a sectional representation of the lid with the opener tab in the opener pivoted position in FIG. 7,
- a sectional representation of the lid with the opener tab in the closure pivoted position in FIG. 8;

FIG. 9 shows a beverage can in side view.

DETAILED DESCRIPTION OF THE PREFERRED EMBODIMENTS

Figure 1:
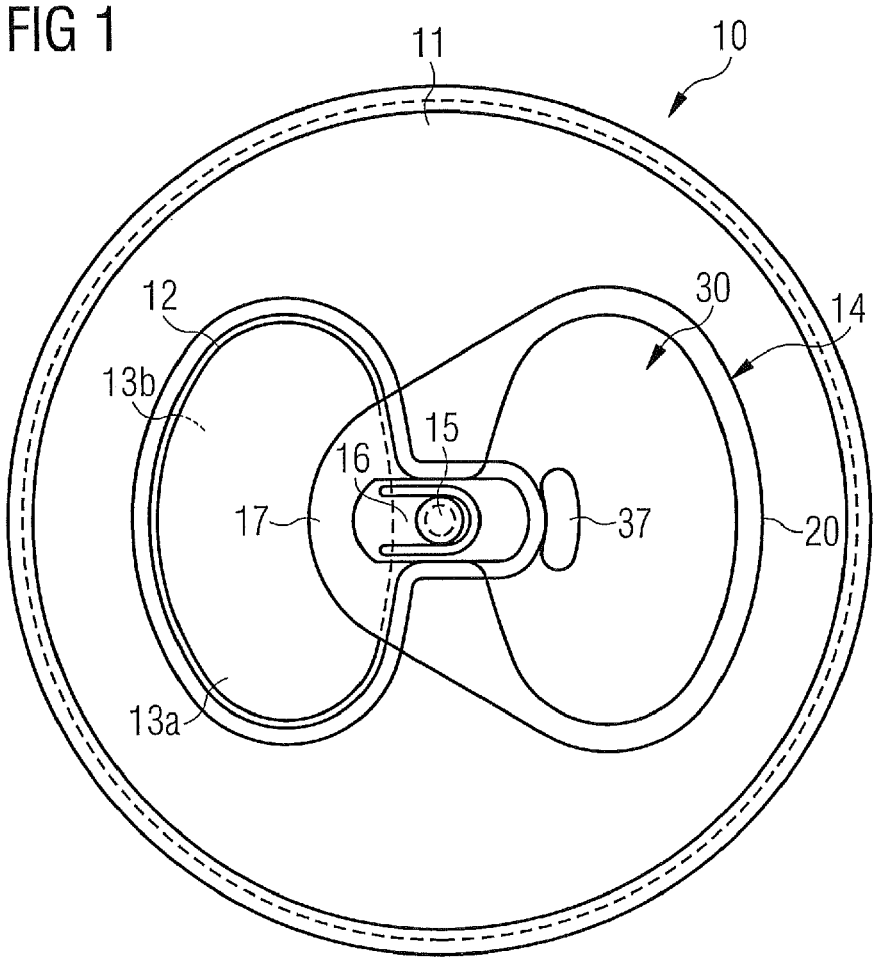
FIG. 1 shows a plan view of a lid plate of a beverage can with a closure according to the invention in the closed state in a schematic representation.

In FIG. 1, a beverage can 10 which is produced as a cylindrical container from an aluminum material is represented in plan view. The beverage can 10 has a lid with a lid plate 11 and with an opener tab 14. Provided in the lid plate 11 is a predetermined breaking line 12, by which an opening 13*b* is marked. In the region of the predetermined breaking line 12, the opener tab 14 is mounted such that it can pivot horizontally about a rivet 15, forming an axis, preferably in the center of the lid plate 11. The rivet 15 penetrates a fastening tongue 16, which is formed on the opener tab 14 and is formed in a resilient manner. During the production of the opener tab 14, the tongue 16 is bent out upward at an angle, for example of approximately 15 to 30°, as represented by dashed lines in FIG. 2, so that in the fully assembled state the tongue 16 is pressed by the rivet 15 downward against the surface of the lid plate 11, so that a resilient prestress is exerted on the opener tab 14.

In the region of the predetermined breaking line 12, the upper tab 14 has a pressing portion 17, which covers over the lid plate 11 and protrudes at least partly into the region of the later opening 13. Lying opposite the projection 17, the opener tab 14 has a gripping portion 18 with a depression 30, and consequently a closure means facing the surface of the lid plate 11. In the exemplary embodiment, the closure means is formed as a closure attachment 31 which projects in a heel-like manner and is adapted in size and shape to the later opening 13. The surrounding surface 19 of the closure attachment 31 may preferably be conically formed, which improves the sealing properties. The rim 20 on the opener tab 14 that is formed by the heel can be grasped for actuating said tab.

Under the closure attachment 31, in FIG. 1 there can be seen a convexity 37 of the lid plate 11, by which the pressing portion 17 is lifted in the closure pivoted position of the opener tab 14, so that the closure attachment 31 is pressed down into the opening 13*b*.

Figure 2:
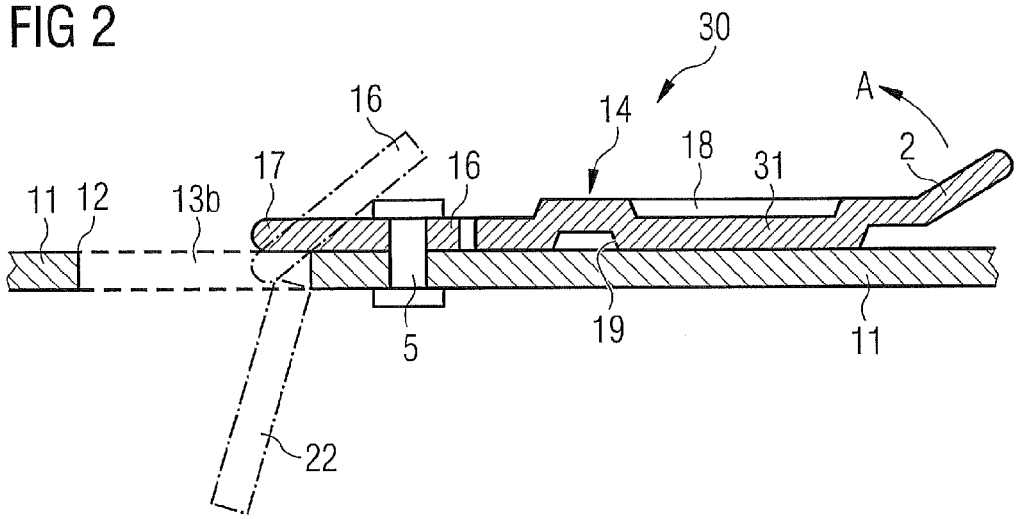
FIG. 2 shows the closure according to FIG. 1 in a schematic, not-to-scale, partial representation in section.
Figure 3:
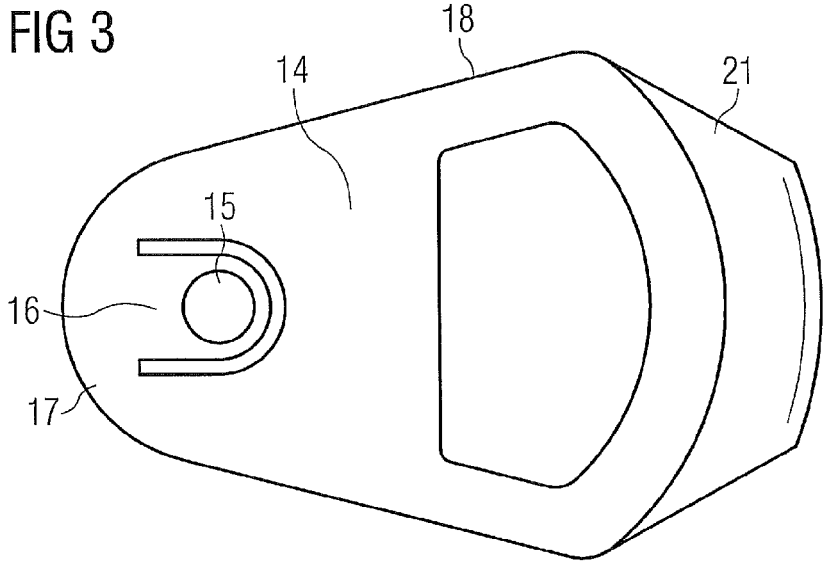
FIG. 3 shows a further exemplary embodiment of an opener tab for a closure according to the invention in a schematic, not-to-scale, representation.

FIGS. 2 and 3 show a second embodiment of a closure according to the invention and of an opener tab 14 according to the invention. The only difference is that the opener tab 14 has at the end opposite from the pressing portion 17 a handle 21, by means of which the opener tab 14 can be securely grasped and actuated.

FIG. 2 further illustrates the operating mode of the closure according to the invention, shared by both embodiments shown in FIGS. 1 and 2. By moving the opener tab 14 vertically in the direction of the arrow A, the pressing portion 17 is pressed onto the breakout portion 13*a*, marked by the predetermined breaking line 12, for breaking out the later opening 13*b*, so that the predetermined breaking line 12 breaks open, whereby the opening 13 is produced. The breakout portion is pressed downward and protrudes as portion 22 into the interior of the container 10, remaining hanging from the underside of the lid plate 11. Once the opening 13*b* has been exposed, the opener tab 14 is moved back at least partly into its original position on account of the spring force of the tongue 16, as represented in FIG. 2.

For closing the opening 13*b*, the opener tab 14 is moved by 180° about the fastening stud 15, so that the closure means 18, formed in the exemplary embodiment as a heel, comes to lie over the opening 13*b*. On account of the spring force of the prestressed tongue 16, the opener tab 14 is pressed downward in the direction of the opening 13 and closes the same. In this case, the closure attachment 31 is pressed into the opening 13*b*, which improves the sealing properties of the closure formed in this way. This operation can be repeated for the repeated opening and closing of the opening 13*b*.

Figure 4:
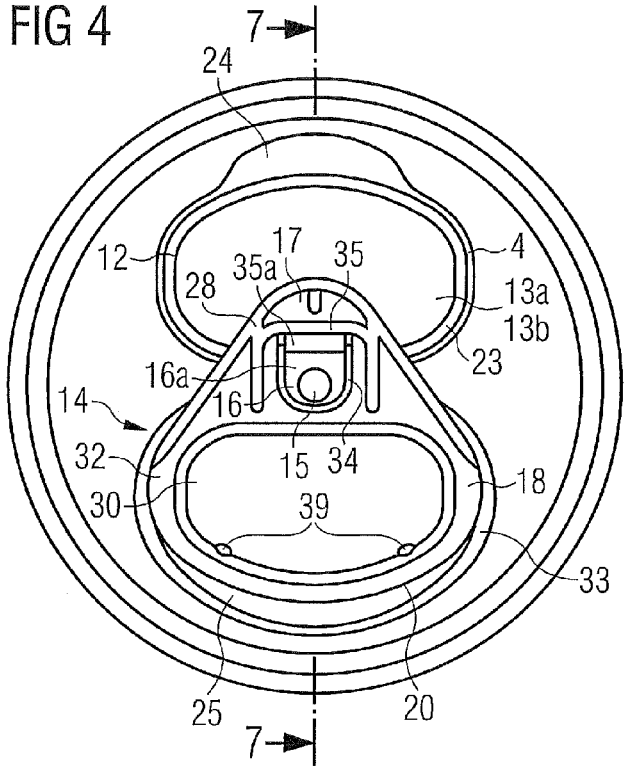
Figure 5:
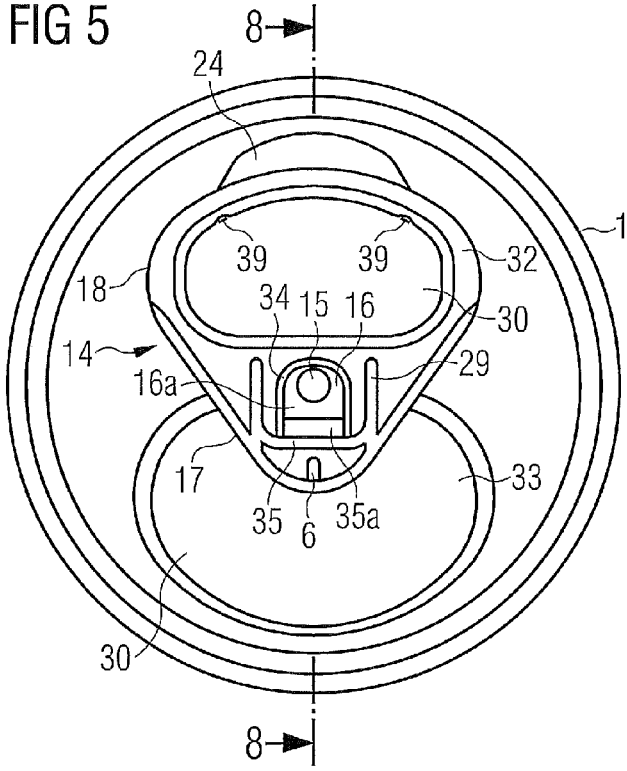
Figure 6:
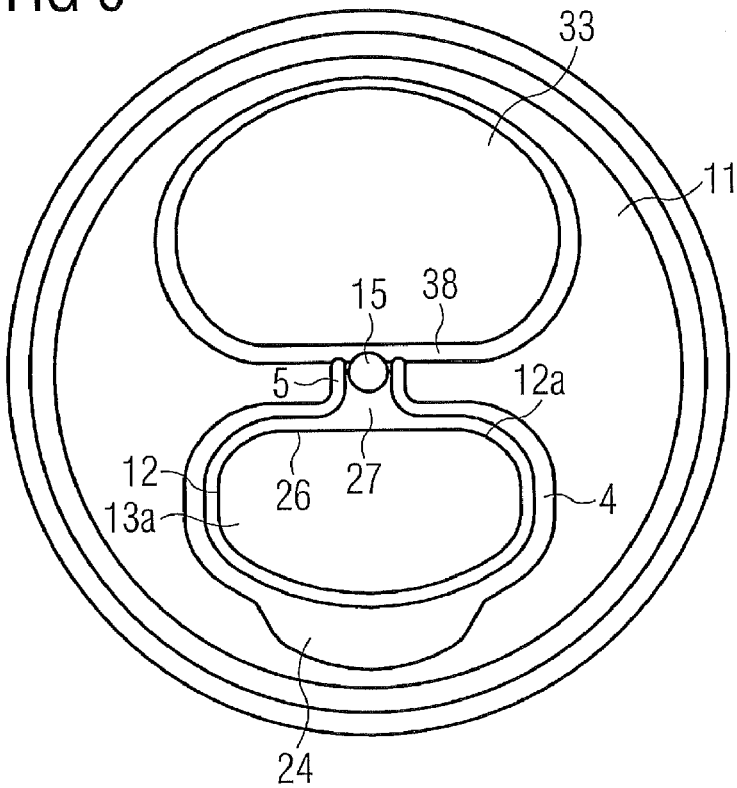

A currently preferred further embodiment of a lid according to the invention can be seen from FIGS. 4 to 6.

In the case of this embodiment also, the lid 1 according to the invention of a container, in particular a beverage can 10 (FIG. 9), is provided with a lid plate 11, in which a breakout portion 13*a* is formed, and with an integrally formed opener tab 14, which for its part is provided with a pressing portion 17 and a gripping portion 18 and also with a fastening tongue 16, which is arranged in a cutout 34 of the opener tab between the pressing portion and the gripping portion and has a foot 35 formed onto the pressing portion 17. With the aid of the fastening tongue 16, the opener tab is pivotably fastened at a fastening stud 15 of the lid plate 11 next to the breakout portion 13*a*, so that, in an opener pivoted position of the opener tap (FIGS. 4 and 7), the breakout portion can be pressed down, and thereby broken out, by the pressing portion by lifting of the gripping portion, and the opening 13*b* bounded by a bounding rim 23 is produced in the lid plate 11.

The fastening stud is preferably a hollow rivet pressed out from the lid plate. If appropriate, however, a solid rivet or some other stud construction may also be used as the fastening stud.

The breakout portion 13*a* is bounded by a predetermined breaking line 12 at least partly, preferably virtually completely, with the exception of a point of interruption 12*a* (FIG. 6). The point of interruptions serves the purpose that—as shown in FIG. 2 at 22—the broken-out breakout portion remains hanging from the rim of the broken-out opening 13*b* and does not fall into the container.

According to the invention, the gripping portion 18 of the opener tab 14 has a depression 30 formed into its upper side at a distance on all sides from its outline 20 (FIG. 4), so that there is formed on the underside facing the lid plate 11*a* flat closure attachment 31. The closure attachment has in side view an outline which is rectangular overall, or virtually rectangular, and the base of which is surrounded by a covering collar 32, which is formed by the underside of the gripping portion 18 around the closure attachment.

The closure attachment consequently has a peripheral surround, the outer surrounding surface 19 of which protrudes from the covering collar 32 at an angle of 90 angular degrees or preferably approximately more than 90 angular degrees, for example 93 to 100 angular degrees.

The surrounding surface 19 has at the height of the covering collar 32 an outline which is at least approximately the same as or geometrically at least approximately similar to the outline of the breakout portion 13*a* determined by the predetermined breaking line 12 (at the same time the opening 13*b*) in the lid plate 11, so that, at its surrounding surface, the closure attachment 31 preferably fits snugly into the bounding rim 23 of the opening 13*b*, and the covering collar 32 rests on the bounding rim of the opening, when the opener tab has been pivoted out of its opener pivoted position (FIGS. 4 and 7) about the fastening stud 15 into a closure pivoted position (FIGS. 5 and 8) and its gripping portion 18 has been pressed down. The underside of the closure attachment 31 preferably runs substantially parallel to the opener tab 14, which is flat overall, preferably planar overall, or is concavely formed, so that the base of the depression 30 runs in a correspondingly planar manner or protrudes convexly upward in its central region, for example by forming of a corresponding peripheral bead in the gripping portion 18.

Moreover, according to the invention, the fastening tongue 16 is formed in an elongated manner, so that between its foot 35, formed onto the pressing portion 17 of the opener tab 14, and the fastening stud 15 there is a freely bendable twisting portion 16*a*. As a result, in the closure pivoted position of the opener tab, such movements of the opener tab, and therefore of the gripping portion, that deviate from a pure swinging movement of the opener tab are possible during the pressing down of the closure attachment into the opening 13*b*, because such deviations from a pure swinging movement can be absorbed by bending and/or twisting of the twisting portion 16*a* of the fastening tongue 16. For example, pressing down of the gripping portion of the opener tab in a direction which runs at least approximately perpendicularly to the lid plate 11 is made possible, so that it is also made possible for the closure attachment 31 to be able to be moved at least approximately perpendicularly to the plane of the opening 13*b* into the latter.

It can also be made possible by the forming of the free portion 16*a* on the fastening tongue 16, for example, to make the closure attachment 31 enter the opening 13*b* somewhat obliquely at first at its rim remote from the fastening tongue, and after that tilt back completely into the opening at the rim facing the fastening tongue, so that the opening rim can interact with the closure attachment 31 in an aligning manner, in order to correct minor positional deviations of the closure attachment.

Furthermore, it is possible by the forming of the twisting portion 16*a* of the fastening tongue 16 to provide a certain degree of compensation for dimensional tolerances and distortions and flexural deformations of the lid plate 11, which may occur during production and in particular during the breaking out of the breakout portion 13*a*.

Figure 7:
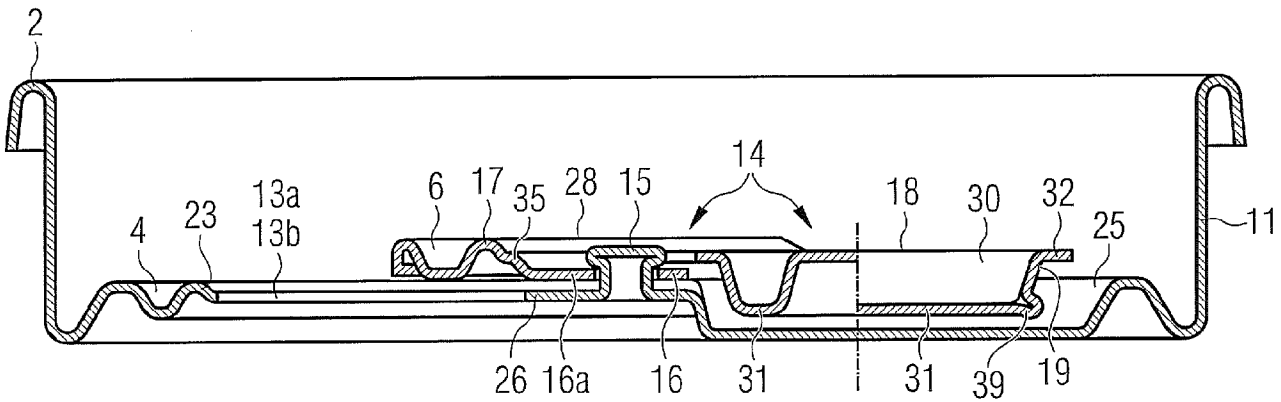

Preferably, the free length of the fastening tongue 16 between its foot line 35 and the fastening stud 15 is somewhat greater than the (smallest) distance 27 (FIG. 6) between the opening 13*b* and the fastening stud 15, so that the fastening tongue 16 protrudes with its foot 35 somewhat beyond the rim portion 26 of the breakout portion 13*a* alongside the fastening stud 15 in the opener pivoted position of the opener tab (FIG. 7). As a result, the bending line about which the opener tab 14 is swung during the breaking out of the breakout portion 13*a* lies over the breakout portion. As a result, it can in turn be prevented that the pressing portion 17 of the opener tab strikes the rim portion 26 of the exposed opening 13*b* alongside the fastening stud 15 during the pressing down of the breakout portion and swinging of it into the container, and that as a result this rim portion and the portions of the bounding rim 23 of the opening alongside it are bent by the pressing portion in an undefined manner. Such flexural deformations could prevent, or at least hinder, the closure attachment 31 from entering the opening when the opening is to be re-closed.

In the case of the lid according to the invention, the breakout portion 13*a*, and therefore the opening 13*b*, may be wider than the pressing portion 17 at that cross-sectional line of the same which in the opener position of the opener tab lies over the portion 26 of the bounding rim 23 of the breakout portion or the opening that is alongside the fastening stud 15. In this respect it is possible to make the opening significantly wider than the pressing portion at said cross-sectional line of the same (FIG. 4), the pressing portion 17 extending as far as possible over the opening 13*b* in the opener position. Since the closure attachment 31 on the gripping portion 18 of the opener tab corresponds in the dimensions of its outline to those of the broken-out opening 13*b*, the gripping portion of an opener tab according to the invention is steadily wider than the pressing portion in adaptation to the size of the opening, the opener tab preferably widening steadily in its connecting portion from its pressing portion to the greatest width of its gripping portion. In this case, the lines of the outline of this connecting portion preferably run along straight lines (FIGS. 4 and 5) or slightly convex arcs.

If the outline of the opening 13*b* runs in a convexly arcuate manner on its side remote from the fastening stud 15, so that the delimiting edge of the gripping portion of an opener tab according to the invention that is remote from the fastening stud likewise runs in a convexly arcuate manner (FIG. 4), the preferred basic form of an opener tab 14 according to the invention, widening steadily from the pressing portion 17 to the gripping portion 18, can also be described as that of an isosceles triangle, the vertex of which is rounded off for forming and delimiting the pressing portion and the sides of which run, in a rounded-off manner, into the convexly arcuate base of the triangle at the gripping portion (see the outline of the opener tab 14 according to FIGS. 4 and 5).

Even though the delimiting rim portion 26 of the broken-out opening 13*b* facing the fastening stud 15 can run in an arcuately concave or convex manner, it is preferred to allow this delimiting rim portion to run along a straight line (FIG. 6), which in the opener position of the opener tab extends parallel to the straight foot line of the fastening tongue. As a result, in particular in the case of the embodiment in which the foot 35 of the fastening tongue 16 protrudes beyond the rim of the opening alongside the fastening tongue 15 in the opener position of the opener tab (FIG. 7), swinging down of the pressing portion by more than 90 degrees can be achieved, for the broken-out breakout portion 13*a* to be swung away completely under the lid plate 11, without the pressing portion 17 striking against the rim portion 26 of the opening 13*b* and possibly bending it.

In a further preferred embodiment, the opener tab 14 as a whole extends parallel at some distance from the lid plate 11, there being formed between the twisting portion 16*a* and the foot line 35 of the fastening tongue 16 a foot portion 35*a* that preferably rises steeply (FIG. 7). This allows the height of the closure attachment 31 to be relatively great and supporting of the opener tab on the connecting line between the twisting portion and the foot portion of the fastening tongue to be achieved (FIG. 8), in order to be able to prize out the closure attachment 31 from the opening 13*b* more easily by pressing down the pressing portion 17.

Figure 8:
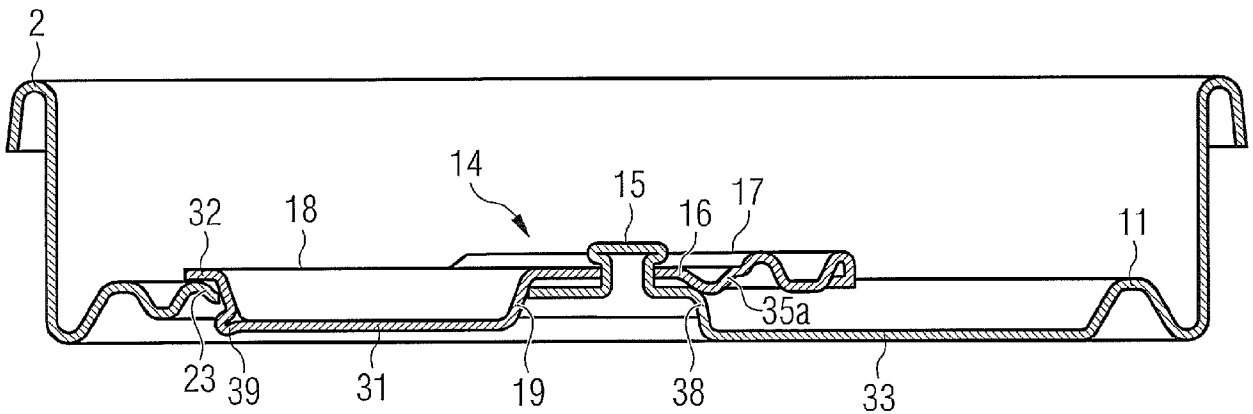

On the side of the fastening stud 15 opposite from the breakout portion 13*a*, and therefore the opening 13*b*, a receiving depression 13 is preferably formed in the lid plate 11 for receiving the protruding closure attachment 31 in the opener position of the opener tab (FIG. 8). The outline of the receiving depression 30 may be little greater than the outline of the closure attachment, but is preferably greater than the outline of the covering collar 32 around the closure attachment 31. In the opener pivoted position of the opener tab, the closure attachment enters the receiving depression as far as the base of the latter (FIG. 7), which lies at a greater depth than the plane of the breakout portion 13*a*, and therefore of the opening 13*b* produced by this breaking out. In the closure pivoted position of the opener tab (FIG. 8), the closure attachment therefore also already enters the opening 13*b* with the fastening tongue 16 undeformed, so that the gripping portion 18 need be pressed out only little until the covering collar 32 rests on the bounding rim 23 of the opening 13*b*.

Moreover, the forming of the receiving depression 33 into the lid plate produces on the underside of the latter a protruding formation, by which the lid plate 11 is reinforced against deforming when the breakout portion is pressed down and broken out. In particular, a reinforcing shoulder 38 can be formed by means of the formation in that region which is adjacent to the fastening stud 15, in order to allow tilting of the fastening stud with simultaneous deforming of the thin lid plate 11 under the considerable pulling force which is exerted laterally on the fastening stud 15 by the fastening tongue 16 of the opener tab during the breaking out of the breakout portion 13*a* to be largely prevented.

It also helps to achieve this if, in a further refinement of the invention, the fastening stud 15 is not arranged as close as possible to the neighboring delimiting portion of the breakout portion but is arranged at a distance 27 from this delimiting rim portion 26, this distance corresponding at least to the diameter of the fastening stud 15 formed as a hollow rivet (FIGS. 7 and 8). This is so because this also has the result that the fastening stud is held in a more stable position on the lid plate 11, so that the pivotability of the opener tab 14 for its pivoting into the closure pivoted position is not impaired. Furthermore, tilting of the fastening stud could cause the dimensional conditions for the position of the closure attachment 31 to be changed so much that it can no longer be aligned with the opening 13*b* by the pivoting of the opener tab and can no longer close said opening.

It is also intended as far as possible that the bounding region of the breakout portion 13*a* cannot be significantly deformed when the breakout portion in the lid plate 11 is pressed down during breaking out of the same. Such permanent deformations can also cause the occurrence of a situation in which the outline of the closure attachment no longer matches the outline of the broken-out opening, so that the latter can no longer be securely closed. It is therefore further preferred for the bounding rim 23 of the breakout portion, and consequently at the same time of the opening 13*b*, to be bounded by a reinforcing annular bead 4 in the lid plate.

Such an annular bead may, moreover, merge in the bounding region of the fastening stud 15 with two reinforcing beads 5 on both sides of the fastening stud (FIG. 6), which for their part end at the formation 38 on the underside of the receiving depression 33.

Maintaining the dimensional conditions for the closure attachment 31 may also depend furthermore on reinforcing the opener tab of a material of small thickness as well as possible against permanent deformation in regions outside the fastening tongue 16. In order to achieve reinforcement of the opener tab against its buckling during the breaking out of the breakout portion, the known opener tabs are also usually crimped along their bounding rim (FIGS. 7 and 8). This may also take place in the case of an opener tab according to the invention. In addition, the pressing portion 17 of the opener tab may be reinforced in the region of its free end by a central bead 6, FIGS. 4, 5 and 7. In addition or as an alternative to a crimped hem along the two lateral delimiting rims of the pressing portion, it has also proven to be favorable to provide a reinforcement of the pressing portion by forming rim reinforcing bulges 28, which reach up to the gripping portion 18 of the opener tab 14 (FIGS. 4 and 5). The gripping portion of an opener tab according to the invention is in any case already reinforced by the forming of the depression 30 or the closure attachment 31.

As further reinforcement of the pressing portion, the rim of the cutout 34 in the opener tab on both sides of the fastening tongue 16 and the foot 35 of the same are preferably reinforced by bulge ribs 29, which are formed in the pressing portion 17 of the opener tab (FIGS. 4 and 5) and can run into the reinforcing bulges 28 on the lateral rims of the pressing portion.

For tightest possible closing of the opening 13*b* in the lid plate 11 by means of the closure attachment 31 of the opener tab 14 in such a way that said attachment is held in the opening, a fit that is as snug as possible can be provided between the closure attachment and the bounding edge 23 of the opening, so that the closure attachment is held down in the opening by the friction between its surrounding surface and the bounding edge of said opening. This can be further assisted by a thin coating of the surrounding surface with a soft plastics material (not shown), into which the bounding edge of the opening can dig itself a little when the closure attachment is pressed into the opening.

In addition or as an alternative to each of the measures described above, latching projections 39 that interact in a latching manner with the bounding edge 23 of the opening 13*b* are formed on the surrounding surface 19 of the closure attachment 31 as a preferred refinement of the invention.

Such latching projections 39, in the exemplary embodiment two latching projections 39, are preferably provided on the portion of the surrounding surface 19 that is remote from the fastening stud 15 by corresponding small impressions being formed into the peripheral wall of the depression 30 of the gripping portion 18 (FIGS. 4, 5, 7, 8).

To allow the gripping portion 18 with its closure attachment 31 to be prized more easily out of the opening 13*b* again, a finger clearance 24 may be formed in the lid plate 11 in the form of a depression on the side of the opening remote from the fastening stud 15, the clearance protruding beyond the covering collar 32 of the gripping portion in the closure pivoted position of the opener tab 14 (FIG. 5). This allows the covering collar to be gripped underneath with the tip of a finger around the closure attachment 31 in its closure position, in order to prize the closure attachment out of the opening. In the presence of the annular bead 4 around the opening rim 23 that is described further above, such a finger clearance 24 in the form of a depression in the lid plate 11 may be made by corresponding convex extension of the annular bead 4 (FIG. 4).

In addition, as already stated further above, the closure attachment 31 can be prized out by pressing down the pressing portion 17 of the opener tab, in particular if on the fastening tongue 16 there is formed a steeply rising foot portion 35*a*, by which the pressing portion 17 is held at some distance above the lid plate 11 when the closure attachment 31 engages in the opening 13*b* (FIG. 7), and if on the side of the fastening stud 15 that is opposite from the opening there is formed in the lid plate a receiving depression 33, which is reached over by the pressing portion 17 in the closure pivoted position (FIG. 8).

A finger clearance 25 is preferably also formed in the lid plate 11 in the form of a depression on the side of the gripping portion 18 remote from the fastening stud 15 in the opener pivoted position of the opener tab 14 (FIGS. 4 and 7). As a result, gripping under the gripping portion 18 with the tip of a finger is made easier when the gripping portion lying flat over the lid plate is to be lifted for breaking out of the breakout portion 13*a*. If the receiving depression 33 for the closure attachment 31 is formed into the lid plate 11, the finger clearance 25 may also be formed by corresponding enlargement of the receiving depression 33 (FIG. 4).

When viewed from below, the closure portion 31 on the underside of the gripping portion 18 may be shaped as a peripheral bulge (FIG. 7, left half of the closure attachment 31) or as a plateau-like elevation (FIG. 7, right half of the closure attachment 31). It is also possible to make the central region of the depression 30 curve upward in an arcuately convex manner, starting from an annular peripheral depression, so that the underside of the closure attachment 31 runs in a correspondingly arcuately concave manner. In all these cases, the outline of the underside of the closure attachment 31 in a side view extends substantially parallel to the covering collar 32.

The underside of the covering collar 32 may have a coating of compliant rubber material or preferably plastics material (not shown), in order that a certain sealing effect is provided in interaction with the bounding rim 23 of the opening 13*b* in the closure pivoted position of the opener tab 14

It was already stated further above that the surrounding surface 19 may also correspondingly have such a coating for sealing and/or holding the closure attachment on the bounding edge of the opening 13*b*.

The lower side of the closure attachment 31 facing the lid plate 11, however, remains preferably uncoated in order that a smallest possible frictional resistance is provided when the opener tab is pivoted out of the opener pivoted position into the closure pivoted position and out of the latter.

As can be seen from the drawing, the lid plate 11 according to the invention, and in particular the opener tab 14 according to the invention, may be produced from a thin plate material, in particular from a metal plate material, with substantially constant wall thickness, which is profiled by deforming techniques such as a combination of punching and deep-drawing for the forming of projections and depressions, such as beads and bulges, in the configuration according to the invention.

The opener tab 14 according to the invention is made as flat as possible overall, in order that sufficient free space remains above the opener tab 14, inside the rim flange 2 of the lid plate 11, the flange projecting a distance above the opener tab, to continue to allow containers, in particular beverage cans, to be stacked by the upper can engaging in the lid of the next-lower can. To allow stacking, a beverage can 10 provided with a lid according to the invention also has, in a way corresponding to FIG. 9, a lower axial annular flange 3, the outside diameter of which is less than the inside diameter of the crimped upper rim flange 2 of the lid. The can body 10 has a correspondingly greater diameter and forms in the region above the lower annular flange 3 an obliquely running annular shoulder 40, with which the can in the stacked state rests on the upper rim flange 2, without the annular flange 3 of the respectively upper can 10 that enters the lid coming into contact with the opener tab.

The invention claimed is:

1. A lid for a beverage can, said lid having a lid plate, in which a breakout portion is formed, and an opener tab, which is provided with a pressing portion and a gripping portion and also with a fastening tongue, which is arranged in a cutout of the opener tab and has a foot formed onto the pressing portion and with which the opener tab is pivotably fastened at a fastening stud of the lid plate next to the breakout portion, which can be pressed down and thereby broken out in an opener pivoted position of the opener tab by the pressing portion by means of lifting the gripping portion, so that in the lid plate there is produced an opening which is bounded by a bounding rim and can be re-closed in a closure pivoted position of the opener tab by a closure attachment, which, by means of a depression being formed into the gripping portion protrudes on the underside of the gripping portion at an angle from a covering collar, wherein the fastening tongue is formed in an elongated manner and has between its foot and the fastening stud a twisting portion, and the closure attachment is formed in a flat manner and has adjoining the covering collar a surrounding surface which corresponds in its outline to the opening, so that the gripping portion can be pressed down in the closure pivoted position of the opener tab into a closed position, in which the closure attachment engages in the opening substantially to the extent that the covering collar rests on the bounding rim of the opening, a receiving depression being formed into the upper side of the lid plate for receiving said closure attachment in the opener pivoted position of the opener tab, so that a protruding formation is formed on the underside of the plate, wherein the bounding rim of the opening is bounded by a reinforcing annular bead formed as a depression into the upper side of the lid plate and a reinforcing lateral bead is formed as a depression into the upper side of the lid plate on each of both sides of the fastening stud and opens out into the annular bead and ends on a reinforcing shoulder of said protruding formation reinforcing the lid plate in a region adjacent to the fastening stud, wherein a finger clearance in the form of a depression is formed into the lid plate on the side of the opening remote from the fastening stud as a convex extension of the annular bead, the finger clearance protruding beyond the covering collar of the gripping portion in the closure pivoted position of the opener tab.

2. The lid as claimed in claim 1, the fastening tongue protruding with its foot beyond the rim portion of the breakout portion alongside the fastening stud in the opener pivoted position of the opener tab.

3. The lid as claimed in claim 2, the opening extending significantly on both sides beyond the pressing portion of the opener tab in the opener position of the latter and the opener tab widening steadily from its pressing portion to its gripping portion.

4. The lid as claimed in claim 3, the side of the opening that is alongside the fastening stud running along a straight line.

5. The lid as claimed in claim 2, the opener tab extending at a distance from the lid plate and there being formed between the foot of the fastening tongue and the twisting portion of the latter a foot portion that is set at an angle to said twisting portion and the pressing portion.

6. The lid as claimed in claim 1, the receiving depression has a larger outline than the outline of the covering collar of the closure attachment and the protruding formation includes said reinforcing shoulder reinforcing the lid plate in the peripheral region of the fastening stud.

7. The lid as claimed in claim 1, the fastening stud of the lid plate being arranged at a distance from the opening that corresponds at least to the diameter of the fastening stud.

8. The lid as claimed in claim 1, wherein the underside of the covering collar has a coating of compliant rubber material or plastics material for providing a sealing effect in interaction with the bounding rim of the opening in the closure position of the opener tab.

9. The lid as claimed in claim 1, the pressing portion of the opener tab being reinforced in the region of its free end by a central bead.

10. The lid as claimed in claim 1, the delimiting rim of the pressing portion of the opener tab being reinforced by a reinforcing bulge up to its gripping portion.

11. The lid as claimed in claim 10, the pressing portion of the opener tab being reinforced by a bulge rib along the foot of the fastening tongue and on both sides of the same along the cutout and portions of the bulge rib running on both sides of the cutout being extended into the reinforcing bulge.

12. The lid as claimed in claim 1, the pressing portion of the opener tab being reinforced by a bulge rib along the foot of the fastening tongue and on both sides of the same along the cutout.

13. The lid as claimed in claim 1, latching projections that interact in a latching manner with the bounding rim of the opening being formed on the surrounding surface of the closure attachment.

14. The lid as claimed in claim 1, a finger clearance being formed in the lid plate on the side of the gripping portion remote from the fastening stud in the opener pivoted position of the opener tab.

15. The lid as claimed in claim 1, the closure attachment being formed as a peripheral bulge.

16. The lid as claimed in claim 1, the closure attachment being formed as a plateau-like elevation.

17. The lid as claimed in claim 1, the lid plate having a protruding rim flange, which rises some distance above the opener tab.

18. The lid as claimed in claim 1, the fastening tongue of the opener tab being formed as a spring tongue, by which the closure attachment of the opener tab is resiliently pressed against the lid plate.

19. A beverage can, with a lid, said lid having a lid plate, in which a breakout portion is formed, and an opener tab, which is provided with a pressing portion and a gripping portion and also with a fastening tongue, which is arranged in a cutout of the opener tab and has a foot formed onto the pressing portion and with which the opener tab is pivotably fastened at a fastening stud of the lid plate next to the breakout portion, which can be pressed down and thereby broken out in an opener pivoted position of the opener tab by the pressing portion by means of lifting the gripping portion, so that in the lid plate there is produced an opening which is bounded by a bounding rim and can be re-closed in a closure pivoted position of the opener tab by a closure attachment, which, by means of a depression being formed into the gripping portion protrudes on the underside of the gripping portion at an angle from a covering collar, wherein the fastening tongue is formed in an elongated manner and has between its foot and the fastening stud a twisting portions, and the closure attachment is formed in a flat manner and has adjoining the covering collar a surrounding surface which corresponds in its outline to the opening, so that the gripping portion can be pressed down in the closure pivoted position of the opener tab into a closed position, in which the closure attachment engages in the opening substantially to the extent that the covering collar rests on the bounding rim of the opening, a receiving depression being formed into the upper side of the lid plate for receiving said closure attachment in the opener pivoted position of the opener tab, so that a protruding formation is formed on the underside of the plate, wherein the bounding rim of the opening is bounded by a reinforcing annular bead formed as a depression into the upper side of the lid plate and a reinforcing lateral bead is formed as a depression into the upper side of the lid plate on each of both sides of the fastening stud and opens out into the annular bead and ends on a reinforcing shoulder of said protruding formation formed reinforcing the lid plate in a region adjacent to the fastening stud, wherein a finger clearance in the form of a depression is formed into the lid plate on the side of the opening remote from the fastening stud as a convex extension of the annular bead, the finger clearance protruding beyond the covering collar of the gripping portion in the closure pivoted position of the opener tab.

20. The beverage can, as claimed in claim 19, with a lid where the lid plate having a protruding rim flange, which rises some distance above the opener tab, and said lid having an axial annular flange being provided at the lower end of the container, radially at a distance from its peripheral body and with an axial length which is less than the distance by which the protruding rim flange of the lid plate rises above the opener tab.

* * * * *